US010909927B2

(12) United States Patent
Yin

(10) Patent No.: US 10,909,927 B2
(45) Date of Patent: Feb. 2, 2021

(54) PIXEL COMPENSATION CIRCUIT AND COMPENSATION METHOD, PIXEL CIRCUIT, AND DISPLAY PANEL

(71) Applicant: BOE TECHNOLOGY GROUP CO., LTD., Beijing (CN)

(72) Inventor: Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/441,723

(22) Filed: Jun. 14, 2019

(65) Prior Publication Data

US 2020/0105197 A1 Apr. 2, 2020

(30) Foreign Application Priority Data

Sep. 28, 2018 (CN) ..... 2018 1 1139784

(51) Int. Cl.
*G09G 3/3258* (2016.01)
*G09G 3/3233* (2016.01)
*G09G 3/3291* (2016.01)

(52) U.S. Cl.
CPC ..... *G09G 3/3258* (2013.01); *G09G 3/3233* (2013.01); *G09G 3/3291* (2013.01); *G09G 2300/043* (2013.01); *G09G 2300/0819* (2013.01); *G09G 2300/0828* (2013.01); *G09G 2300/0842* (2013.01)

(58) Field of Classification Search
CPC .. G09G 3/3233; G09G 3/3258; G09G 3/3291; G09G 2300/043; G09G 2300/0819; G09G 2300/0828; G09G 2300/0842
See application file for complete search history.

(56) References Cited

U.S. PATENT DOCUMENTS 3,924,229 A * 12/1975 Liu ..... H03M 1/76 341/127
2008/0180365 A1* 7/2008 Ozaki ..... G09G 3/3233 345/76
2016/0035281 A1* 2/2016 Jeon ..... G09G 3/006 345/690

* cited by examiner

*Primary Examiner* — Alexander Eisen
*Assistant Examiner* — Nathaniel P Brittingham
(74) *Attorney, Agent, or Firm* — Thomas | Horstemeyer, LLP

(57) ABSTRACT

The present disclosure relates to the technical field of displays, and provides a pixel compensation circuit, which includes a detection circuit, a first compensation circuit, and a second compensation circuit. The detection circuit is configured to detect a threshold voltage of a driving transistor; the first compensation circuit being configured to write a first reference voltage to a source electrode of the driving transistor; the second compensation circuit being configured to write a second compensation voltage to a control terminal of the driving transistor at the same time of writing the first reference voltage to the source electrode of the driving transistor. The second compensation voltage is equal to a difference between the threshold of the driving transistor and a first compensation voltage.

18 Claims, 7 Drawing Sheets

PIXEL COMPENSATION CIRCUIT AND COMPENSATION METHOD, PIXEL CIRCUIT, AND DISPLAY PANEL

CROSS REFERENCE TO RELATED APPLICATIONS

The present application is based upon, and claims the benefit of and priority to Chinese Patent Application No. 201811139784.0, filed on Sep. 28, 2018, the entire disclosure of which being hereby incorporated by reference as a part of the present application.

TECHNICAL FIELD

The present disclosure relates to the technical field of displays and, in particular, to a pixel compensation circuit and a compensation method, a pixel circuit, and a display panel.

BACKGROUND

A flat panel display, such as an organic light-emitting diode (OLED) display or the like, includes a plurality of pixel driving circuits to supply driving signals to respective pixels, thereby controlling the brightness of each pixel and realizing a display of an image. In an OLED pixel driving circuit, it has been discovered that a threshold voltage of a driving transistor may affect luminance of the OLED.

It should be noted that the information disclosed in the Background section above is only for enhancement of understanding of the background of the present disclosure and thus, may include information that does not constitute prior art known to those of ordinary skill in the art.

SUMMARY

An objective of the present disclosure is to provide a pixel compensation circuit and a compensation method, a pixel circuit, and a display panel.

According to one aspect of the present disclosure, there is provided a pixel compensation circuit for compensating an output current of a driving transistor in a pixel driving circuit, including: a detection circuit, a first compensation circuit, and a second compensation circuit. The detection circuit is configured to detect a threshold voltage of the driving transistor. The first compensation circuit is configured to write a first reference voltage to a source electrode of the driving transistor, wherein the first reference voltage includes an opposite number of a first compensation voltage, and the first compensation voltage is obtained according to the threshold voltage of the driving transistors in all pixel driving circuits on a display panel. The second compensation circuit is configured to write a second compensation voltage to a control terminal of the driving transistor at the same time of writing the first reference voltage to the source electrode of the driving transistor, wherein the second compensation voltage is equal to a difference between the threshold voltage of the driving transistor and the first compensation voltage.

In an exemplary embodiment of the present disclosure, the detection circuit includes: a detection sub-circuit; a sense line, a first transistor, and a detection capacitor. The sense line is connected to the detection sub-circuit, wherein the detection sub-circuit is configured to detect a voltage on the sense line. The first transistor has a first terminal connected to the source electrode of the driving transistor, a second terminal connected to the sense line, and a control terminal for receiving a first control signal to control a conduction between the first terminal and the second terminal of the first transistor. The detection capacitor has a first electrode connected to the sense line, and a second electrode connected to the ground.

In an exemplary embodiment of the present disclosure, the detection circuit further includes a second transistor. The second transistor has a first terminal connected to the sense line, a second terminal connected to an initialization signal terminal, and a control terminal for receiving a second control signal to control a conduction between the first terminal and the second terminal of the second transistor.

In an exemplary embodiment of the present disclosure, the first compensation circuit includes: a register, a digital-to-analog converter, a subtraction circuit, and a third transistor. The register is configured to store a digital signal of the first compensation voltage. The digital-to-analog converter is configured to convert the digital signal of the first compensation voltage into the first compensation voltage. The subtraction circuit has a first input terminal for receiving the second reference voltage, and a second input terminal for receiving the first compensation voltage. The third transistor has a first terminal connected to the sense line, a second terminal connected to an output terminal of the subtraction circuit, and a control terminal for receiving a third control signal to control a conduction between the first terminal and the second terminal of the third transistor.

In an exemplary embodiment of the present disclosure, the second reference voltage is greater than zero.

According to one aspect of the present disclosure, there is provided a pixel compensation circuit for compensating an output current of a driving transistor in a pixel driving circuit, including: a sense line, a first transistor, a detection capacitor, a second transistor, a register, a digital-to-analog converter, a subtraction circuit, and a third transistor. The sense line is connected to a detection sub-circuit, wherein the detection sub-circuit is configured to detect a voltage on the sense line. The first transistor has a first terminal connected to a source electrode of the driving transistor, a second terminal connected to the sense line, and a control terminal for receiving a first control signal to control a conduction between the first terminal and the second terminal of the first transistor. The detection capacitor has a first electrode connected to the sense line, and a second electrode connected to the ground. The second transistor has a first terminal connected to the sense line, a second terminal connected to an initialization signal terminal, and a control terminal for receiving a second control signal to control a conduction between the first terminal and the second terminal of the second transistor. The register configured to store a digital signal of a first compensation voltage. The digital-to-analog converter is configured to convert the digital signal of the first compensation voltage into the first compensation voltage. The subtraction circuit has a first input terminal for receiving a second reference voltage and a second input terminal for receiving the first compensation voltage, wherein the first compensation voltage is obtained according to the threshold voltage of the driving transistor in all pixel driving circuits on a display panel. The third transistor has a first terminal connected to the sense line, a second terminal connected to the output terminal of the subtraction circuit, and a control terminal for receiving a third control signal to control a conduction between the first terminal and the second terminal of the third transistor.

According to one aspect of the present disclosure, there is provided a pixel compensation method for compensating an output current of a driving transistor in a pixel driving circuit, including:

acquiring a threshold voltage of a driving transistor in the pixel driving circuit;

writing a first reference voltage to a source electrode of the driving transistor, wherein the first reference voltage includes an opposite number of the first compensation voltage, and the first compensation voltage is obtained according to threshold voltages of the driving transistors in all pixel driving circuits on a display panel; and at the same time of writing the first reference voltage to the source electrode of the driving transistor, writing a second compensation voltage into a control terminal of the driving transistor, the second compensation voltage being equal to a difference between a threshold of the driving transistor and the first compensation voltage.

In an exemplary embodiment of the present disclosure, acquiring threshold voltages of the driving transistors in all pixel driving circuits on a display panel includes: for each of the driving transistors, applying a control voltage to the control terminal of the driving transistor to turn on the driving transistor;

detecting a critical voltage of the source electrode of the driving transistor when an output current of the driving transistor is changed from non-zero to zero; and acquiring the threshold voltage of the driving transistor according to the control voltage and the critical voltage.

In an exemplary embodiment of the present disclosure, before applying a control voltage to a control terminal of the driving transistor to turn on the driving transistor, the method further includes:

inputting an initialization signal to the source electrode of the drive transistor.

In an exemplary embodiment of the present disclosure, obtaining the first compensation voltage according to threshold voltages of the driving transistors in all pixel driving circuits on the display panel includes:

calculating an average of the threshold voltages of all drive transistors, and taking the average as the first compensation voltage.

According to one aspect of the present disclosure, a pixel circuit is provided, including: a light emitting device; a driving circuit; and the pixel compensation circuit described above. The driving circuit is for driving the light emitting device to emit light. The pixel compensation circuit is for compensating for an output current of a driving transistor in the driving circuit.

According to one aspect of the present disclosure, a display panel is provided, including the above pixel circuit.

The present disclosure provides a pixel compensation circuit and a compensation method, a pixel circuit, and a display panel.

It should be understood that both the foregoing general description and the following detailed description are exemplary and explanatory only and are not restrictive of the disclosure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure. Understandably, the drawings in the following description are only some embodiments of the present disclosure, and other drawings may be obtained by those skilled in the art from the drawings without creative effort.

DETAILED DESCRIPTION

Figure 1:
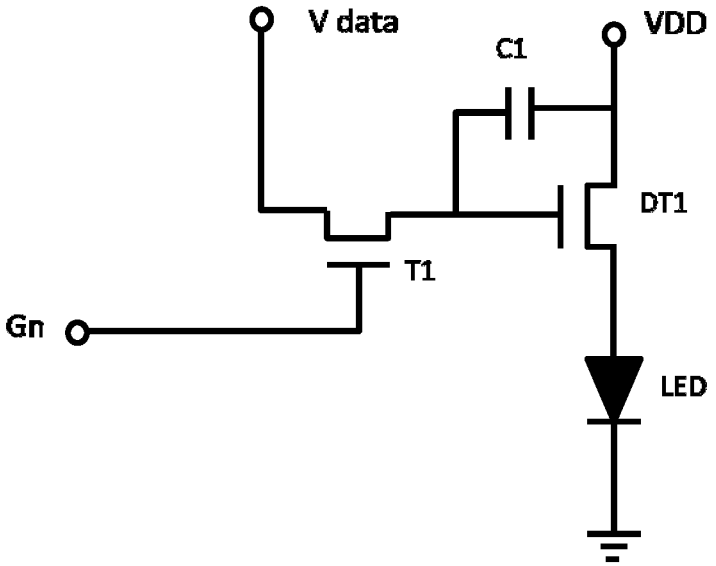
FIG. 1 is a schematic structural diagram of a pixel driving circuit according to a comparison embodiment.

Exemplary embodiments will now be described more fully with reference to the accompanying drawings. However, the exemplary embodiments can be embodied in a variety of forms and should not be construed as being limited to the examples set forth herein. Rather, these embodiments are provided to make the present disclosure more comprehensive and complete, and to fully convey the concept of the exemplary embodiments to those skilled in the art. The same reference numerals in the drawings denote the same or similar structures, and, thus, their detailed description will be omitted.

Although the relative terms such as "on" and "under" are used in the specification to describe the relative relationship of one component to another component as illustrated, these terms are used in this specification for convenience only, for example, according to the exemplary direction shown in the accompanying drawings. It will be understood that if the device illustrated is flipped upside down, the component described as "on" will become the component "under." Other relative terms, such as "high", "low", "top", "bottom", "left", "right", etc., also have similar meanings. When a structure is "on" other structure, it may mean that a structure is integrally formed on other structure, or that a structure is "directly" disposed on other structure, or that a structure is "indirectly" disposed on other structure through another structure.

The terms "a", "an", and "the" are used to mean the presence of one or more elements/components, etc.; the terms "including" and "having" are as nonexclusive inclusion and additional elements/components/etc. may be present in addition to the listed elements/components/etc.

FIG. 1 is a schematic structural diagram of a pixel driving circuit according to a comparison embodiment. A 2T1C structure is a typical pixel driving circuit structure. As shown in FIG. 1, in the comparison embodiment, the pixel driving circuit generally includes a driving transistor DT1, a switching transistor T1, and a charging capacitor C1. In the comparison embodiment, according to the I-V characteristic of the driving transistor DT1, when the driving transistor DT1 is completely turned on, an output current of the driving transistor is:

$$Iout = \frac{1}{2}\mu C\frac{W}{L} \times (Vgs - Vth)^2 = \frac{1}{2}\mu C\frac{W}{L} \times (Vg - Vs - Vth)^2$$

Where C is an oxide capacitor of the driving transistor DT1; W and L are aspect ratios of the driving transistor DT1; Vg is a voltage of the gate electrode of the driving transistor, that is, Vdata; Vs is a voltage of the source electrode of the driving transistor; and Vth is a threshold voltage of the driving transistor.

As can be seen from the above formula of the output current of the driving transistor DT1, an output current of the driving transistor DT1 is related to the threshold voltage of the driving transistor DT1. However, during the operation of the pixel driving circuit, the threshold voltage of the driving transistor may drift, thereby causing a deviation in the output current of the driving transistor DT', causing a difference in luminance of the OLED, and a sand leakage phenomenon occurring in the displayed image. In the comparison embodiment, the threshold voltage Vth of the driving transistor DT1 is usually written in the data signal Vdata1 by an external compensation, so that the voltage on the gate electrode of the driving transistor becomes Vg+Vth, then:

$$Iout = \frac{1}{2}\mu C\frac{W}{L} \times (Vgs - Vth)^2 = \frac{1}{2}\mu C\frac{W}{L} \times (Vg + Vth - Vs - Vth)^2 = \frac{1}{2}\mu C\frac{W}{L} \times (Vg - Vs)^2.$$

This can eliminate the effect of Vth on normal display. However, in the comparison embodiment, the dynamic range of Vth is large, and the power required for the source driving circuit to increase the Vdata is large.

Figure 2:
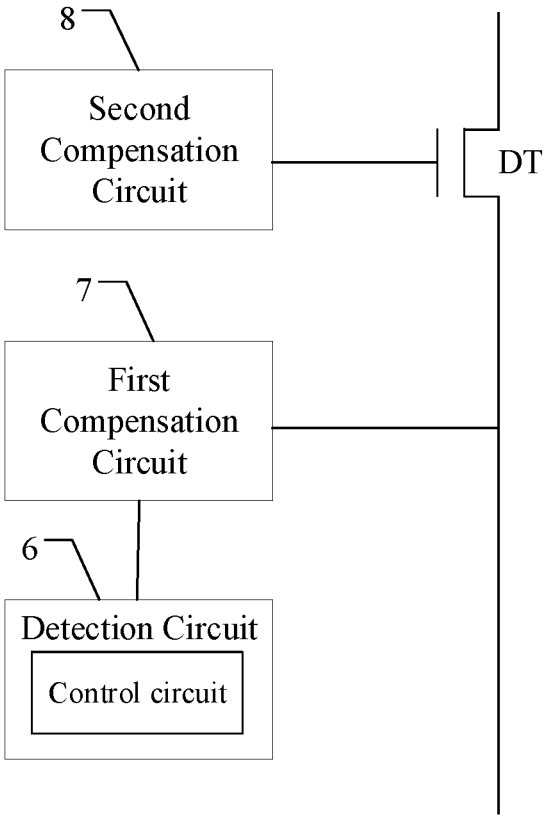
FIG. 2 is a schematic structural diagram of an exemplary embodiment of a pixel compensation circuit according to the present disclosure.

Based on the foregoing, an exemplary embodiment first provides a pixel compensation circuit for compensating the output current of the driving transistor in the pixel driving circuit, as shown in FIG. 2, which is a schematic structural diagram of an exemplary embodiment of a pixel compensation circuit according to the present disclosure. The pixel compensation circuit includes a detection circuit 6, a first compensation circuit 7, and a second compensation circuit 8. The detection circuit 6 is configured to detect a threshold voltage of the driving transistor. The first compensation circuit 7 is configured to write a first reference voltage Vref1 to the source electrode of the driving transistor DT, and the first reference voltage is obtained by subtracting a first compensation voltage V1 from a second reference voltage Vref2. The first compensation voltage is obtained according to threshold voltages of driving transistors in a plurality of pixel driving circuits. The second compensation circuit is configured to, at the same time of writing the first reference voltage to the source electrode of the driving transistor, write a second compensation voltage V2 to the control terminal of the driving transistor, the second compensation voltage being equal to a difference between a threshold of the driving transistor and the first compensation voltage, that is V2=Vth−V1.

In the exemplary embodiment, the first compensation voltage may be obtained according to the threshold voltages of driving transistors in at least two pixel driving circuits on the display panel. In another exemplary embodiment, the first compensation voltage may be obtained according to the threshold voltages of driving transistors on a predetermined area of the display panel, e.g., quarter of the display panel, a half of the display panel, or the like. In yet another exemplary embodiment, the first compensation voltage is obtained according to threshold voltages of driving transistors in all pixel driving circuits on the display panel. In the exemplary embodiment, the first compensation voltage may be an average of the threshold voltages of all drive transistors on the display panel. It should be understood that, in other exemplary embodiments, the first compensation voltage may also be a median value, a percentile value, and the like of the threshold voltages of all drive transistors on the display panel.

In the exemplary embodiment, the first reference voltage Vref1 may be equal to a difference between the second reference voltage Vref2 and the first compensation voltage V1. Thus, an output current of the driving transistor is:

$$Iout = \frac{1}{2}\mu C\frac{W}{L} \times (Vg - Vs - Vth)^2 = \frac{1}{2}\mu C\frac{W}{L} \times (Vdata + V2 - Vref1 - Vth)^2 = \frac{1}{2}\mu C\frac{W}{L} \times (Vdata + Vth - V1 - Vref2 + V1 - Vth)^2 = \frac{1}{2}\mu C\frac{W}{L} \times (Vdata - Vref2)^2$$

In the above formula, Iout is not affected by the threshold Vth of the driving transistor, and thus, the threshold Vth of the driving transistor can be compensated. Also, the dynamic range of the second compensation voltage V2 is small; thus, it can reduce the power requirement of the source driving circuit.

The present exemplary embodiment provides a pixel compensation circuit. The pixel compensation circuit includes a first compensation circuit and a second compensation circuit. In the present disclosure, a compensation voltage is obtained by the first compensation circuit and the second compensation circuit, and the original compensation voltage can be decomposed into a constant first compensation voltage and a second compensation voltage with a small dynamic variation range. On one hand, the pixel compensation circuit can reduce the power requirement of the source driving circuit. On the other hand, the pixel compensation circuit can have a simple structure and a low cost.

Figure 3:
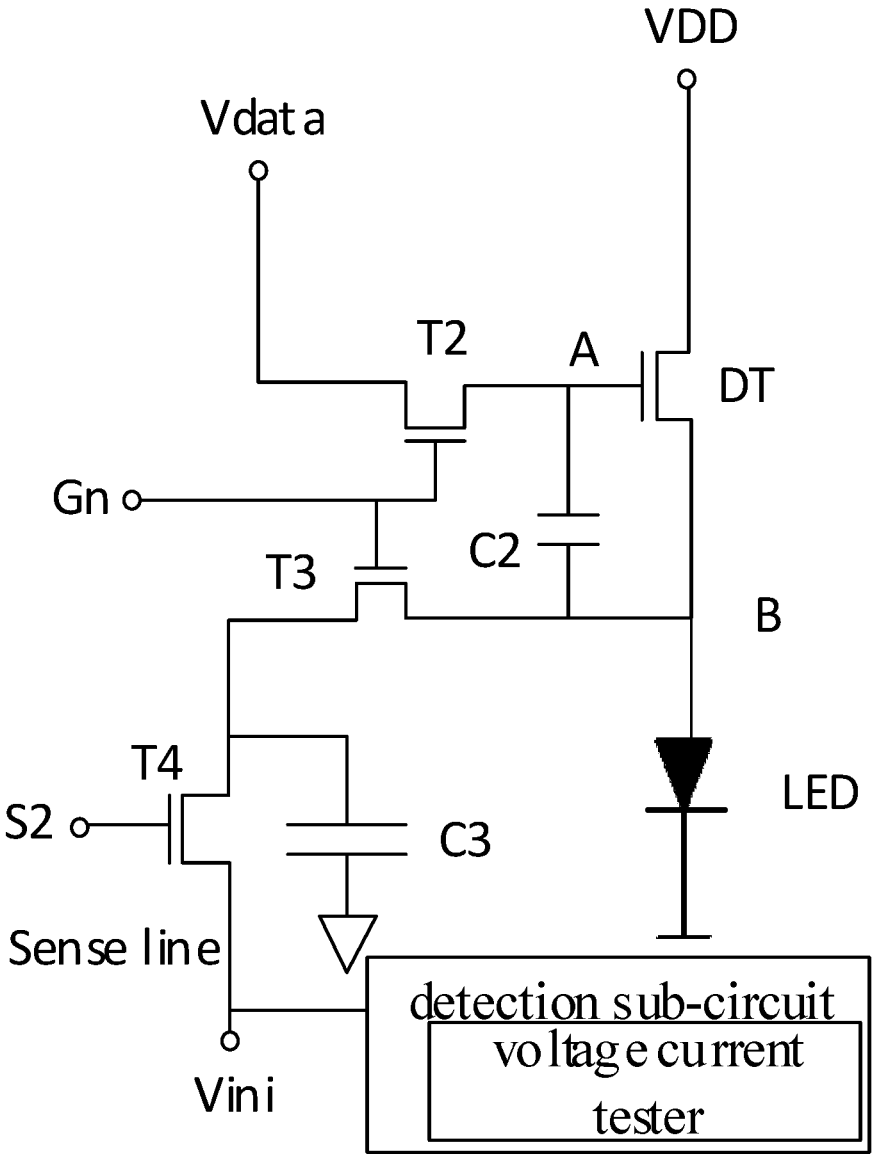
FIG. 3 is a schematic structural diagram of a detection circuit in an exemplary embodiment of a pixel compensation circuit according to the present disclosure.

In the exemplary embodiment, a schematic structural diagram of a detection circuit in an exemplary embodiment of the pixel compensation circuit according to the present disclosure is shown in FIG. 3, the pixel driving circuit being described by taking a 2T1C structure as an example. The pixel driving circuit includes a driving transistor DT, a switching transistor T2, and a charging capacitor C2. The switching transistor T2 and the driving transistor DT may each be an N-channel transistor. The switching transistor T2 has a first terminal for receiving a data signal Vdata, a second terminal connected to the control terminal of the driving transistor DT, a control terminal connected to a gate driving signal Gn, a drain electrode connected to a high level VDD, and a source electrode connected to an input terminal of the OLED. The charging capacitor C2 has two electrode terminals connected respectively to a second terminal of the switching transistor T2 and the source terminal of the driving transistor DT. The detection circuit may include a detection sub-circuit, a sense line, a first transistor T3, and a detection capacitor C3. The sense line is connected to the detection sub-circuit, and the detection sub-circuit is connected to one terminal of the first transistor T3. The detection sub-circuit may be integrated in the source driving circuit for detecting voltage and current on the sense line. The detection sub-circuit may be a voltage current tester. The first transistor T3 has the first terminal connected to the source electrode of the driving transistor DT, a second terminal connected to the sense line, and a control terminal for receiving a first control signal to control conduction or cut-off between the first terminal and the second terminal of the first transistor. The detection capacitor C3 has a first electrode connected to the sense line, and a second electrode connected to ground. In the present exemplary embodiment, the first control signal may also be the gate driving signal Gn.

In order to avoid the influence of the residual charges in the detection capacitor C3 on the detecting structure, in the exemplary embodiment, the detection circuit may further include a second transistor T4. The second transistor T4 has a first terminal connected to the sense line, a second terminal connected to an initialization signal terminal Vini, and a control terminal for receiving a second control signal S2 to control conduction or cut-off between the first terminal and the second terminal of the second transistor.

Figure 4:
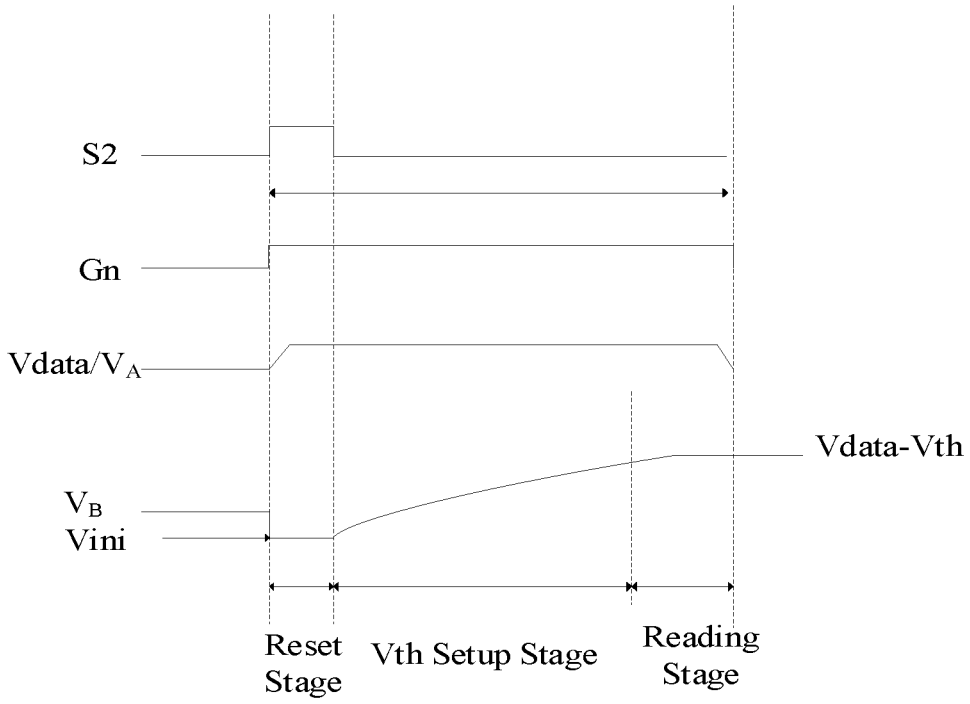
FIG. 4 is a timing diagram of operation of a detection circuit in an exemplary embodiment of a pixel compensation circuit according to the present disclosure.

In the exemplary embodiment, a timing diagram is shown in FIG. 4 illustrating operation of the detection circuit in an exemplary embodiment of the pixel compensation circuit according to the present disclosure, where $V_B$ is a voltage at the source electrode point B of the driving transistor DT; and $V_A$ is a voltage at the gate electrode point A of the driving transistor DT. The process of the detection circuit detecting the threshold voltage of the driving transistor DT includes three stages: (1) a reset stage, (2) a Vth setup stage, and (3) a reading stage.

(1) In the reset stage, the gate driving signal Gn and the second control signal S2 are both at a high level, and the switching transistor T2, the first transistor T3, and the second transistor T4 are both turned on. The initialization signal terminal Vini charges the detection capacitor C3 and the charging capacitor C2 through the second transistor T4, and restores the $V_B$ and the sense line to the initial voltage Vini. The data signal Vdata is charged to the charging capacitor C2, and the voltage of the $V_A$ is Vdata.

(2) In the Vth setup stage, the second control signal S2 is at a low level, the gate driving signal Gn is at a high level, the first transistor T3 and the switching transistor T2 are turned on, and the second transistor T4 is turned off. The data signal Vdata can continuously input the data signal Vdata to the gate electrode of the driving transistor DT, and the voltage of $V_A$ is Vdata. The output current Iout of the driving transistor DT can continuously charge the detection capacitor C3, so that the voltage $V_B$ at the point B voltage continuously rises until the output current Iout of the driving transistor DT is zero, and then the voltage $V_B$ at the point B does not rise any more.

In order to ensure that the data signal Vdata can charge the charging capacitor C2 and the detection capacitor C3 during the Vth setup stage, it is necessary to ensure Vini<Vdata−Vth; and in order to ensure that the OLED remains cut off during the reset stage and the Vth setup stage, it is necessary to ensure Vdata−Vth<VLED+ELVSS, where VLED is the driving voltage of the OLED and ELVSS is the output voltage of the OLED.

(3) In the reading stage, from the formula:

$$Iout = \frac{1}{2}\mu C\frac{W}{L} \times (Vgs - Vth)^2 = \frac{1}{2}\mu C\frac{W}{L} \times (Vg - Vs - Vth)^2,$$

It can be seen that when Iout is zero, the voltage $V_B$ at the B point (i.e., Vs) is equal to Vdata (i.e., Vg)−Vth, and the voltage $V_B$ at the point B is the voltage on the sense line. In this case, the voltage $V_B$ at the point B can be obtained by detecting the voltage on the sense line by the detection sub-circuit. With the known value Vdata, it can be calculated to obtain Vth=Vdata−$V_B$.

It should be understood that, according to the above embodiment, the detection circuit may include a control circuit to implement the above-described operation. For example, the control circuit may be configured to: apply a control voltage to the control terminal of the driving transistor to turn on the driving transistor; detect a critical voltage of the source electrode of the driving transistor when an output current of the driving transistor is changed from non-zero to zero; and acquire the threshold voltage of the driving transistor according to the control voltage and the critical voltage. It should be further understood that the control circuit may be disposed in the detection circuit or may be separately provided and electrically connected to the detection circuit.

Further, it should be understood that in other exemplary embodiments, the detection sub-circuit may have more optional components, all of which are within the scope of the present disclosure.

In the exemplary embodiment, the first reference voltage is equal to the difference between the second reference voltage and the first compensation voltage. To ensure that the OLED does not emit light when the pixel is driven, the first reference voltage is lower than the anode voltage for the OLED normally emitting light. The second reference voltage is lower than the sum of the anode voltage of the OLED and the first compensation voltage. On the other hand, to ensure that the pixel driving voltage outputted by the data driving integrated circuit is a positive voltage, the second reference voltage is positive. In one embodiment of the present disclosure, the register 1 may be a memory circuit disposed in the compensation circuit, which may include a memory unit for storing data for storing the digital signal of the first compensation voltage. Additionally, in one embodiment of the present disclosure, the digital to analog converter 2 is a device configured to convert a digital signal to an analog signal. Typically, the digital to analog converter 2 may include circuit modules such as a weight resistor network, an operational amplifier, a reference power supply, and an analog switch; however, the present disclosure is not limited thereto, and according to a specific application scenario, the digital-to-analog converter 2 may omit one or more of the above-described circuit modules or further include one or more other circuit modules, or may adopt different configurations. A person skilled in the art can select a suitable register and a digital-to-analog converter as needed, which is not particularly limited in the present disclosure.

Figure 5:
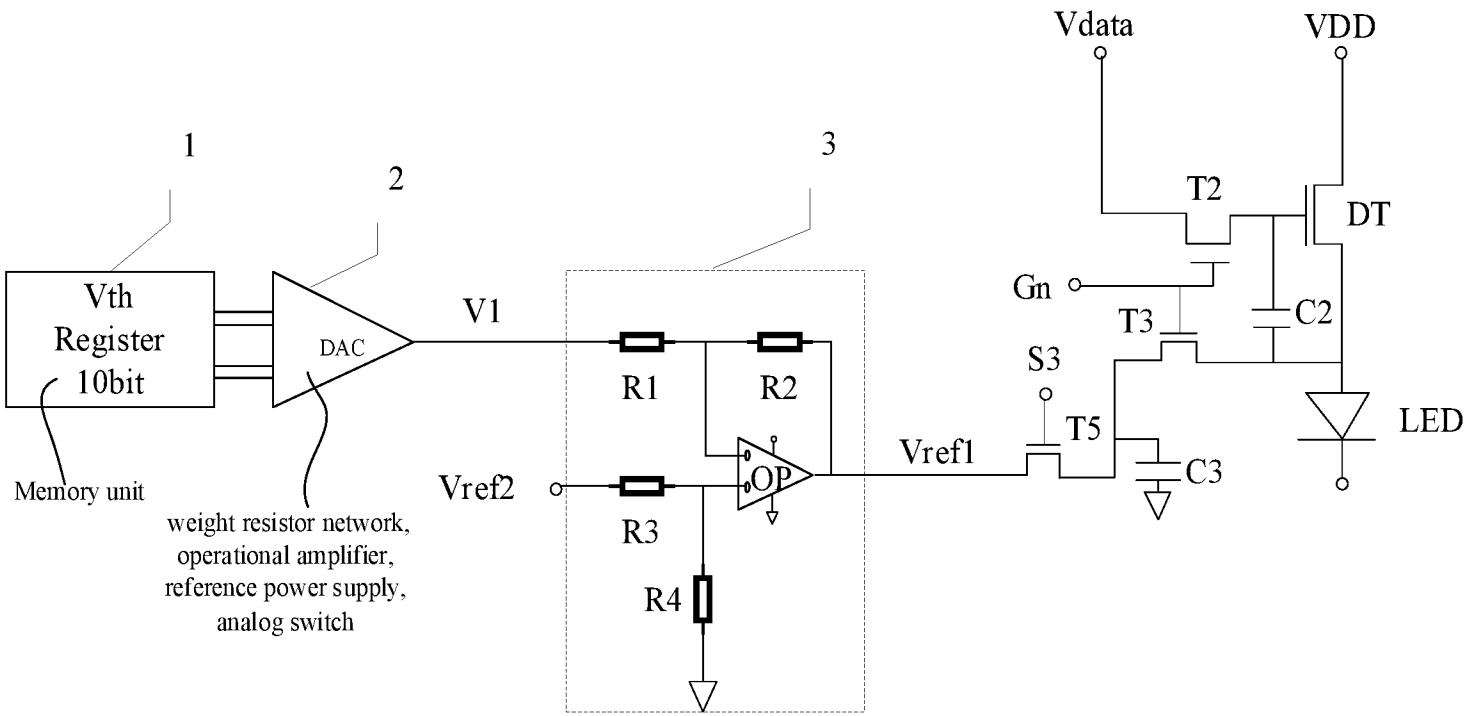
FIG. 5 is a schematic structural diagram of a first compensation circuit in an exemplary embodiment of a pixel compensation circuit according to the present disclosure.

In the exemplary embodiment, as shown in FIG. 5, which is a schematic structural diagram of a first compensation circuit in an exemplary embodiment of a pixel compensation circuit according to the present disclosure, the first compensation circuit includes a register 1, a digital-to-analog converter 2, a subtraction circuit 3, and a third transistor T5. The register 1 is configured to store a digital signal of the first compensation voltage. The digital-to-analog converter 2 is configured to convert the digital signal of the first compensation voltage into the first compensation voltage V1. The subtraction circuit 3 has a first input terminal for receiving a second reference voltage Vref2, and a second input terminal for receiving the first compensation voltage V1. The third transistor T5 has a first terminal connected to the sense line, a second terminal connected to an output terminal of the subtraction circuit 3, and a control terminal for receiving a third control signal S3 to control a conduction between the first terminal and the second terminal of the third transistor T5 (i.e., to control whether the first and second terminals are electrically conducted or cut-off). In a threshold voltage detecting stage, when the third control signal S3 is at a low level, the third transistor T5 is turned off, and the detection circuit detects the threshold voltage Vth of the driving transistor DT. In an OLED driving stage, when the third control signal S3 is at a high level, the third transistor T5 is turned on and, at the same time, the second control signal S2 in the detection circuit outputs a low level, the second transistor T4 is turned off, and the gate driving signal Gn is at a high level, the first transistor T3 is turned on, and the voltage outputted from the output terminal of the subtraction circuit 3 is Vref2−V1 (i.e., the first reference voltage Vref1). It should be understood that the first compensation circuit may have more optional components in other exemplary embodiments, all of which are within the scope of the present disclosure.

In the exemplary embodiment, as shown in FIG. 5, the subtraction circuit 3 may include an operational amplifier OP, a first resistor R1, a second resistor R2, a third resistor R3, and a fourth resistor R4. The first resistor R1 has a first terminal connected to a first input terminal of the operational amplifier OP, and a second terminal forming a first input terminal of the subtraction circuit. The second resistor has a first terminal connected to the first input terminal of the operational amplifier OP, and a second terminal connected to an output terminal of the operational amplifier OP. The third resistor R3 has a first terminal connected to a second input terminal of the operational amplifier OP, and a second terminal forming a second input terminal of the subtraction circuit. The fourth resistor R4 has a first terminal connected to the second input terminal of the operational amplifier OP, and a second terminal connected to ground. R1=R2=R3=R4. It should be understood that in other exemplary embodiments, the subtraction circuit may have more optional components, all of which are within the scope of the present disclosure.

In the present exemplary embodiment, the second compensation circuit may be integrated on the source driving circuit, and the second compensation circuit may be identical to the external compensation circuit structure in the related art.

Figure 6:
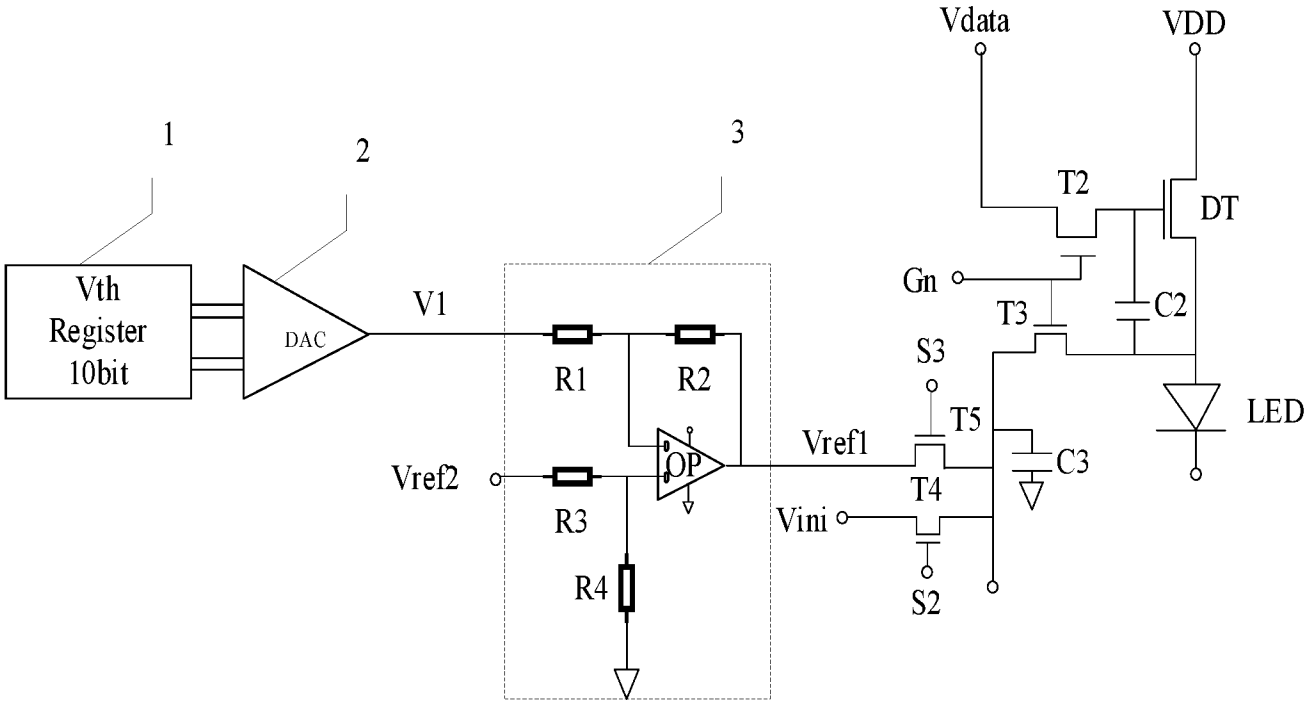
FIG. 6 is a schematic structural diagram of a pixel compensation circuit according to the present disclosure.

An exemplary embodiment further provides a pixel compensation circuit for compensating the output current of the driving transistor in the pixel driving circuit, as shown in FIG. 6, which is a schematic structural diagram of a pixel compensation circuit according to the present disclosure. The pixel compensation circuit includes a sense line, a register 1, a digital-to-analog converter 2, a first transistor T3, a detection capacitor C3, a second transistor T4, a subtraction circuit 3, and a third transistor T5. The register 1 is configured to store a digital signal of the first compensation voltage. The digital-to-analog converter 2 is configured to convert the digital signal of the first compensation voltage into the first compensation voltage V1. The sense line is connected to a detection sub-circuit (not shown). The detection sub-circuit is configured to detect the voltage on the sense line. The first transistor has a first terminal connected to the source electrode of the driving transistor, a second terminal connected to the sense line, and a control terminal for receiving a first control signal to control a conduction between the first terminal and the second terminal of the first transistor. The detection capacitor has a first electrode connected to the sense line and a second electrode connected to the ground. The second transistor has a first terminal connected to the sense line, a second terminal connected to the initialization signal terminal Vini, and a control terminal for receiving a second control signal S2 to control a conduction between the first terminal and the second terminal of the second transistor. The subtraction circuit has a first input terminal for receiving a second reference voltage, a second input terminal for receiving the first compensation voltage, wherein the first compensation voltage is obtained according to a threshold voltage of a driving transistor in all pixel driving circuits on the display panel. The third transistor has a first terminal connected to the sense line, a second terminal connected to the output terminal of the subtraction circuit, and a control terminal for receiving a third control signal S3 to control a conduction between the first terminal and the second terminal of the third transistor.

The pixel compensation circuit provided by the exemplary embodiment has the same technical features and operation principles as the pixel compensation circuit described above, and the above content has been described in detail, which will not be repeated herein.

Figure 7:
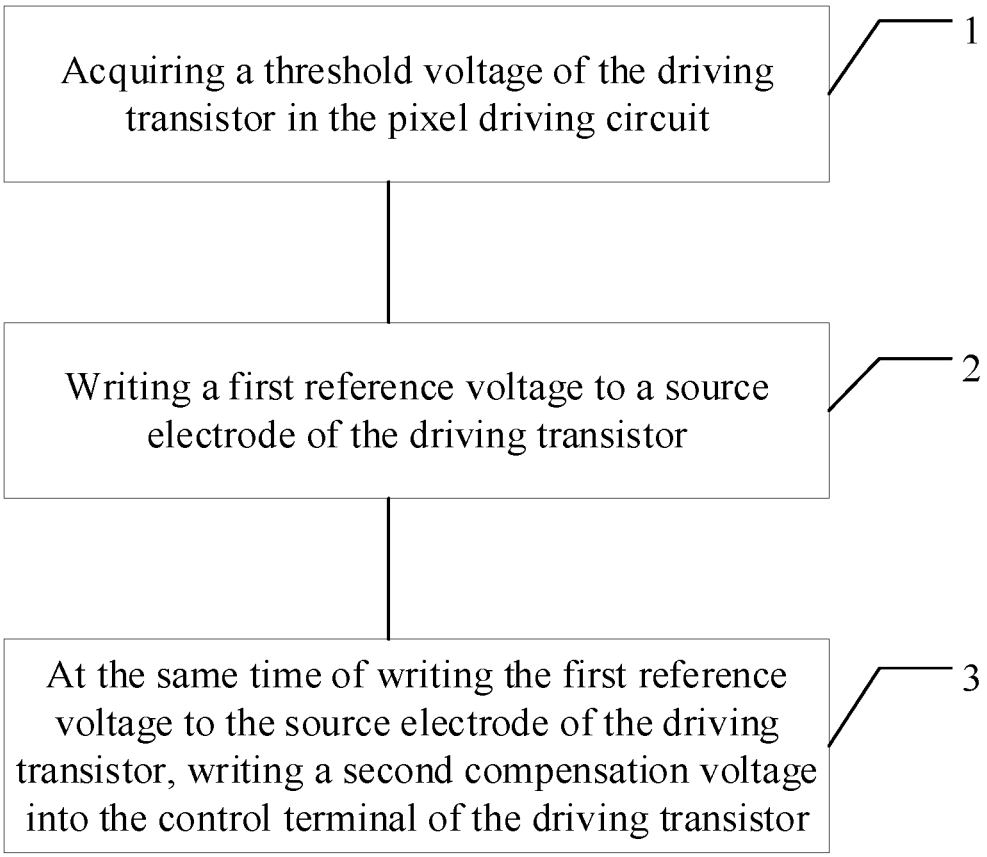
FIG. 7 is a flow chart of an exemplary embodiment of a pixel compensation method according to the present disclosure.

The present exemplary embodiment also provides a pixel compensation method for compensating for an output current of a driving transistor in a pixel driving circuit, as shown in FIG. 7, is a flow chart of an exemplary embodiment of a pixel compensation method according to the present disclosure. The method includes the following steps.

In Step 1, a threshold voltage of the driving transistor in the pixel driving circuit is acquired.

In Step 2, a first reference voltage is written to a source electrode of the driving transistor, wherein the first reference voltage includes an opposite number of the first compensation voltage, and the first compensation voltage is obtained according to threshold voltages of the driving transistors in all pixel driving circuits on the display panel.

In Step 3, at the same time of writing the first reference voltage to the source electrode of the driving transistor, a second compensation voltage is written into the control terminal of the driving transistor, the second compensation voltage being equal to a difference between a threshold of the driving transistor and the first compensation voltage.

In the exemplary embodiment, acquiring threshold voltages of the driving transistors in all pixel driving circuits on the display panel includes: for each of the driving transistors, applying a control voltage to a control terminal of the driving transistor to turn on the driving transistor;

detecting a critical voltage of a source electrode of the driving transistor when an output current of the driving transistor is changed from non-zero to zero; and acquiring the threshold voltage of the driving transistor according to the control voltage and the critical voltage.

In the exemplary embodiment, before applying a control voltage to a control terminal of the driving transistor to turn on the driving transistor, the method further includes:

inputting an initialization signal to a source electrode of the drive transistor.

In the exemplary embodiment, obtaining the first compensation voltage according to threshold voltages of the driving transistors in all pixel driving circuits on the display panel includes:

calculating an average of the threshold voltages of all drive transistors, and taking the average as the first compensation voltage. It should be understood that in other exemplary embodiments, the first reference voltage may also be a median value, a percentile value, and the like of the threshold voltages of all drive transistors on the display panel.

The pixel compensation method provided by the exemplary embodiment has the same technical features and operation principles as the pixel compensation circuit described above, and the above content has been described in detail, which will not be repeated herein.

The present exemplary embodiment also provides a pixel circuit including a light emitting device, a driving circuit, and the above pixel compensation circuit. The driving circuit is configured to drive the light emitting device to emit a light. The pixel compensation circuit is configured to compensate an output current of the driving transistor in the driving circuit.

Figure 8:
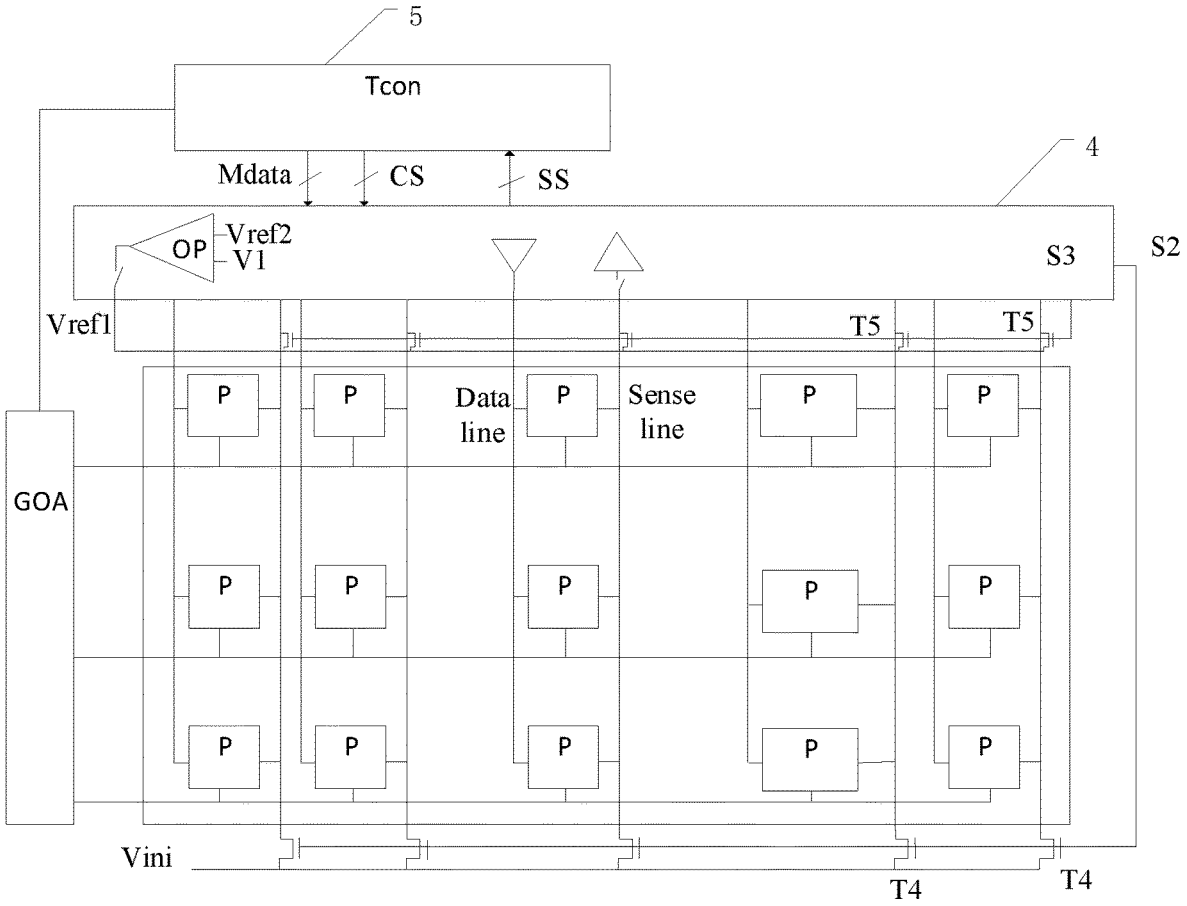
FIG. 8 is a schematic structural diagram of an exemplary embodiment of a display panel according to the present disclosure.

An exemplary embodiment further provides a display panel, as shown in FIG. 8, which is a schematic structural diagram of the exemplary embodiment of a display panel according to the present disclosure. The display panel includes the above-described pixel circuit, a source driving circuit 4, and a logic board 5. The second control signal S2 and the third control signal S3 in the pixel compensation circuit described above can be implemented by programming the source driving circuit 4. The first transistor T3 may be integrated in the pixel driving circuit, the second transistor T4 may be disposed on the non-display area on the lower side of the display panel, and the third transistor T5 may be disposed on the non-display area on the upper side of the display panel. The detection sub-circuit, the register 1, the digital-to-analog converter 2, and the subtraction circuit can be integrated on the source drive circuit. The sensing signal SS sensed by the detection sub-circuit can be transmitted to the logic board 5. The logic board 5 is configured to operate on the sensing signal SS to obtain a first compensation voltage and a second compensation voltage, and control the source driving circuit through the control signal CS to input the first reference voltage to the sense line, and control the source driving circuit through a data signal Mdata to input the second compensation voltage to the data line.

In the present disclosure, the compensation voltage is obtained by the first compensation circuit and the second compensation circuit, and the original compensation voltage can be decomposed into a constant first compensation voltage and a second compensation voltage with a small dynamic variation range. On one hand, the pixel compensation circuit can reduce the power requirement of the source driving circuit. On the other hand, the pixel compensation circuit can have a simple structure and a low cost.

Other embodiments of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

The features, structures, or characteristics described above may be combined in any suitable manner in one or more embodiments, and the features discussed in the various embodiments are interchangeable, if possible. In the above description, numerous specific details are set forth to provide a thorough understanding of the embodiments of the present disclosure. However, one skilled in the art will appreciate that the technical solution of the present disclosure may be practiced without one or more of the specific details, or other methods, components, materials, and the like may be employed. In other instances, well-known structures, materials, or operations are not shown or described in detail to avoid obscuring aspects of the present disclosure.

What is claimed is:

1. A pixel compensation circuit for compensating an output current of a driving transistor in a pixel driving circuit, comprising:

a detection circuit configured to detect a threshold voltage of the driving transistor;

a first compensation circuit configured to write a first reference voltage to a source electrode of the driving transistor, wherein the first reference voltage is obtained by subtracting a first compensation voltage from a second reference voltage, and the first compensation voltage is obtained according to the threshold voltage of the driving transistor in at least one of a plurality of pixel driving circuits; and a second compensation circuit configured to write a second compensation voltage to a control terminal of the driving transistor at a same time of writing the first reference voltage to the source electrode of the driving transistor, wherein the second compensation voltage is equal to a difference between the threshold voltage of the driving transistor and the first compensation voltage.

2. The pixel compensation circuit according to claim 1, wherein the detection circuit comprises a control circuit, and the control circuit is configured to:

apply a control voltage to the control terminal of the driving transistor to turn on the driving transistor;

detect a critical voltage of the source electrode of the driving transistor when the output current of the driving transistor is changed from non-zero to zero; and acquire the threshold voltage of the driving transistor according to the control voltage and the critical voltage.

3. The pixel compensation circuit according to claim 1, wherein the detection circuit comprises:

a detection sub-circuit;

a sense line connected to the detection sub-circuit, wherein the detection sub-circuit is configured to detect a voltage on the sense line;

a first transistor having a first terminal connected to the source electrode of the driving transistor, a second terminal connected to the sense line, and a control terminal for receiving a first control signal to control a conduction between the first terminal and the second terminal of the first transistor; and a detection capacitor having a first electrode connected to the sense line and a second electrode connected to ground.

4. The pixel compensation circuit according to claim 3, wherein the detection sub-circuit comprises a voltage current tester.

5. The pixel compensation circuit according to claim 3, wherein the detection circuit further comprises:

a second transistor having a first terminal connected to the sense line, a second terminal connected to an initialization signal terminal, and a control terminal for receiving a second control signal to control a conduction between the first terminal and the second terminal of the second transistor.

6. The pixel compensation circuit according to claim 3, wherein the first compensation circuit comprises:

a register configured to store a digital signal of the first compensation voltage;

a digital-to-analog converter configured to convert the digital signal of the first compensation voltage into the first compensation voltage;

a subtraction circuit having a first input terminal for receiving the second reference voltage, and a second input terminal for receiving the first compensation voltage; and a third transistor having a first terminal connected to the sense line, a second terminal connected to an output terminal of the subtraction circuit, and a control terminal for receiving a third control signal to control a conduction between the first terminal and the second terminal of the third transistor.

7. The pixel compensation circuit according to claim 6, wherein the register comprises a memory unit for storing data.

8. The pixel compensation circuit according to claim 6, wherein the digital-to-analog converter comprises a weight resistor network, an operational amplifier, a reference power supply, and an analog switch.

9. The pixel compensation circuit according to claim 1, wherein the second reference voltage is greater than zero.

10. A pixel compensation circuit for compensating an output current of a driving transistor in a pixel driving circuit, comprising:

a sense line connected to a detection sub-circuit, wherein the detection sub-circuit is configured to detect a voltage on the sense line;

a first transistor having a first terminal connected to a source electrode of the driving transistor, a second terminal connected to the sense line, and a control terminal for receiving a first control signal to control a conduction between the first terminal and the second terminal of the first transistor;

a detection capacitor having a first electrode connected to the sense line, and a second electrode connected to ground;

a second transistor having a first terminal connected to the sense line, a second terminal connected to an initialization signal terminal, and a control terminal for receiving a second control signal to control a conduction between the first terminal and the second terminal of the second transistor;

a register configured to store a digital signal of a first compensation voltage;

a digital-to-analog converter configured to convert the digital signal of the first compensation voltage into the first compensation voltage;

a subtraction circuit having a first input terminal for receiving a second reference voltage, and a second input terminal for receiving the first compensation voltage, wherein the first compensation voltage is obtained according to a threshold voltage of the driving transistor in at least one of a plurality of pixel driving circuits; and a third transistor having a first terminal connected to the sense line, a second terminal connected to an output terminal of the subtraction circuit, and a control terminal for receiving a third control signal to control a conduction between the first terminal and the second terminal of the third transistor.

11. The pixel compensation circuit according to claim 10, wherein the detection sub-circuit comprises a control circuit, and the control circuit is configured to:

apply a control voltage to the control terminal of the driving transistor to turn on the driving transistor;

detect a critical voltage of a source electrode of the driving transistor when the output current of the driving transistor is changed from non-zero to zero; and acquire the threshold voltage of the driving transistor according to the control voltage and the critical voltage.

12. The pixel compensation circuit according to claim 10, wherein the detection sub-circuit comprises a voltage current tester.

13. A pixel compensation method for compensating an output current of a driving transistor in a pixel driving circuit, comprising:

acquiring a threshold voltage of a driving transistor in the pixel driving circuit;

writing a first reference voltage to a source electrode of the driving transistor, wherein the first reference voltage comprises an opposite number of a first compensation voltage, and the first compensation voltage is obtained according to the threshold voltage of the driving transistor in at least one of a plurality of pixel driving circuits; and at the same time of writing the first reference voltage to the source electrode of the driving transistor, writing a second compensation voltage into a control terminal of the driving transistor, the second compensation voltage being equal to a difference between a threshold of the driving transistor and the first compensation voltage.

14. The pixel compensation method according to claim 13, wherein acquiring the threshold voltage of the driving transistor in at least one of the plurality of pixel driving circuits comprises, for each of the driving transistors:

applying a control voltage to the control terminal of the driving transistor to turn on the driving transistor;

detecting a critical voltage of the source electrode of the driving transistor when the output current of the driving transistor is changed from non-zero to zero; and acquiring the threshold voltage of the driving transistor according to the control voltage and the critical voltage.

15. The pixel compensation method according to claim 14, wherein, before applying the control voltage to the control terminal of the driving transistor to turn on the driving transistor, the method further comprises: inputting an initialization signal to the source electrode of the drive transistor.

16. The pixel compensation method according to claim 13, wherein obtaining the first compensation voltage according to the threshold voltage of the driving transistor in at least one of the plurality of pixel driving circuits comprises: calculating an average of threshold voltages of all drive transistors, and taking the average as the first compensation voltage.

17. The pixel compensation circuit according to claim 1, further comprising:

a light emitting device;

a driving circuit for driving the light emitting device to emit light; and the pixel compensation circuit being configured to compensate for an output current of the driving transistor in the pixel driving circuit.

18. The pixel compensation circuit according to claim 17, the pixel compensation circuit being a portion of a display panel, the display panel comprising the pixel driving circuit.

* * * * *